United States Patent [19]

Tsukumo

[11] 4,052,021

[45] Oct. 4, 1977

[54] BOBBIN HANGER

[75] Inventor: Zenzaburo Tsukumo, Ikeda, Japan

[73] Assignees: NTN Toyo Bearing Co. Ltd., Ikeda; Zenzaburo Tsukumo, Osaka, both of Japan

[21] Appl. No.: 655,488

[22] Filed: Feb. 5, 1976

[30] Foreign Application Priority Data

Jan. 17, 1976 Japan ..... 51-4283

[51] Int. Cl.[2] ..... B65H 49/02; D03J 5/08

[52] U.S. Cl. ..... 242/130.2

[58] Field of Search ..... 242/129.7, 130.2; 57/127.5, 127.7; 68/198, 212

[56] References Cited

U.S. PATENT DOCUMENTS

| | | | |
|---|---|---|---|
| 3,481,165 | 12/1969 | Tigges | 68/198 |
| 3,512,731 | 5/1970 | Kitamura | 242/130.2 |
| 3,877,659 | 4/1975 | Takata | 242/130.2 |

*Primary Examiner*—Leonard D. Christian

*Attorney, Agent, or Firm*—Hall & Houghton

[57] ABSTRACT

There is disclosed a bobbin hanger comprising an upper assembly serving for attachment and aligning suspension, an intermediate assembly serving for constrained rotation and alignment, and a lower assembly serving for removable mounting and aligning suspension of a bobbin. Below the upper assembly, the intermediate assembly is suspended through a pivot having enlarged head portions at both ends thereof, and a dust-proof filter is incorporated between the upper and intermediate assemblies for prevention of entry of fly and dust.

7 Claims, 9 Drawing Figures

5
4
6
7
3
16
11
2
c
d
8
e
40
a
f
42
10
9
1

5
6
7
14
13
2
1
4
12
15
8

BOBBIN HANGER

BACKGROUND OF THE INVENTION

1. Field to the Invention

The present invention relates to a bobbin hanger.

2. Description of the Prior Art

The upper assemblies of conventional bobbin hangers are not very much different from each other. In a typical form of such conventional bobbin hanger, as shown in FIG. 1, inside a rotor 8 a pivot 1 is integral with a bolt 4, providing at the lower portion a bearing and swing motion mechanism, and on the intermediate portion of the clamp bolt a cap 2 is held in position by a clamp nut 13. At the upper portion, the bobbin hanger is attached to a hanger attaching rail 5 by a square bolt 6 and a fixing clamp nut 14. Finally, a protector 12 for protection against airborne short fibers, or so-called "fly" is provided over the rotor 8. Thus, the conventional article is complicated in construction, having a large number of parts, and requires much time and labor in mounting and dismounting operation and yet not much of the expected effect can be obtained. Fly tends to enter the bobbin hanger and since the pivot is integrally connected to the hanger attaching rail, the formation of rust and dew on the pivot due to heat conduction detracts from the performance of the bobbin hanger and causes many troubles. In addition, 15 designates a ball for rolling movement and 7 designates a washer.

SUMMARY OF THE INVENTION

The present invention relates to a bobbin hanger for use primarily with textile machines and includes an assembly wherein in order to threadedly attach the upper and lower assemblies of a bobbin hanger to a bobbin hanger attaching rail for suspension or transport of bobbins by using a rational arrangement meeting the functional requirements of bobbin hangers, a clamp bolt and a bearing pivot (hereinafter referred to simply as pivot) are gripped in a self-centering universal joint fashion. The assembly comprises a pivot housing split usually into two sections, which are adapted to be put together by being inerted into a cylindrical long aperture formed in a cap. Thus, basically the invention provides a vertical suspension device whereby the bobbin hanger is completely isolated from the bobbin hanger attaching rail in terms of operation, air current convection and heat conduction. Further, associated with said device, as necessary adjuncts the invention provides a lower suspension structure and a seal structure for prevention of entry of fly and dust.

FEATURES OF THE INVENTION

The first feature of the present invention is that in order to eliminate the various disadvantages described above, there is provided a bisected pivot housing whereby the pivot and the lower assembly are completely isolated from the bobbin hanger attaching rail in terms of operation, convection and heat conduction, as described above, said pivot housing, as shown in FIGS. 2 and 3, being provided with a lower recess in which, when the pivot housing halves are put together, the head of the pivot is held in a self-centering universal joint fashion, and with an upper recess adapted to receive the head of a clamp bolt to be threadedly secured to the hanger attacing body. Thus, said lower recess receives the pivot in a self-centering universal joint fashion while the upper recess fixedly receives the head of the clamp bolt, and the pivot housing itself is fitted in a cylindrical long aperture formed inside a cap when the housing halves are put together.

This arranngement is advantageous in that the hanger upper assembly can be easily and securely threadedly attached to the hanger attaching rail, that fixing and detachment are easy and that the number of parts is minimum.

The second feature of the invention is the provision of a protector for prevention of entry of fly and dust into the rotatable bearing structure when the upper and lower assemblies in the vertical suspension device of the present invention are in self-centering universal joint condition.

DESCRIPTION OF THE PREFERRED EMBODIMENTS

Figure 2:
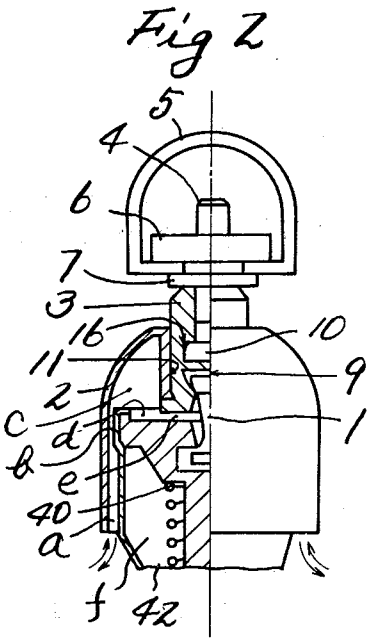
FIG. 2 is a sectional view of an embodiment of the hanger upper assembly of the present invention.

FIG. 2 shows an embodiment of the present invention, illustrating the upper assembly of a hanger threadedly secured to a hanger attaching body with the parts shown in partial section. A bisected pivot housing 3 is provided with a lower recess 9 for receiving the head of a pivot 1 in a self-centering universal joint fashion, and an upper recess 10 for similarly receiving the head 16 of a clamp bolt 4 which is threadedly secured to a hanger attaching body 5 with a washer and a loosening-preventive specially shaped polygon head nut 6. The pivot housing 3 itself is fitted in a cylindrical long aperture 11 formed inside a cap 2 whereby it is integrally embraced and fixed in position.

Figure 3:
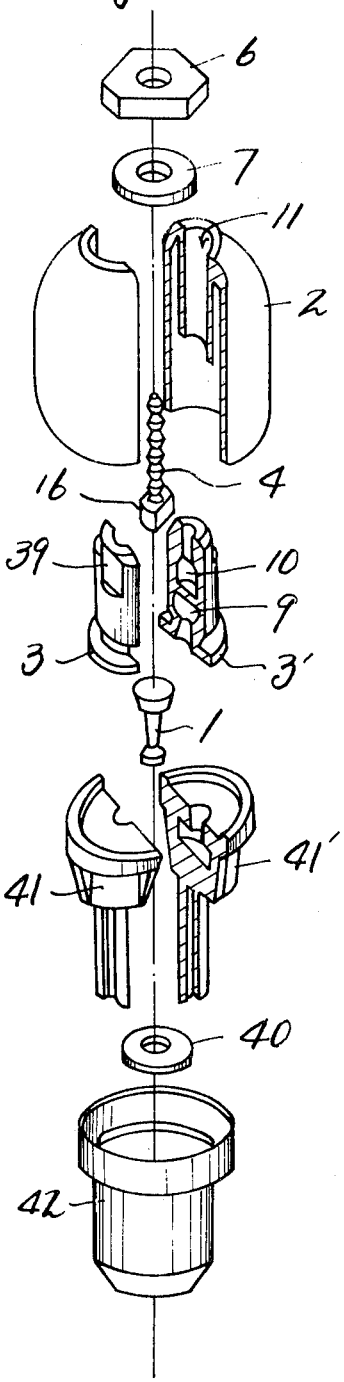
FIG. 3 is an exploded perspective view of the upper assembly of the present invention.

FIG. 3 is a perspective view showing the pivot 1, the internal structures of the bisected pivot housing 3, 3' and cap 2, and the bolt 4 and besides them it also shows the relation thereto of a rotor bearing member for rotatably suspending the lower assembly. As shown in FIG. 3, the bisected housing 3, 3' is internally provided with a lower recess 9 for receiving the head of the pivot 1 in a self-centering universal joint fashion and an upper recess 10 for receiving the head 16 of the clamp bolt 4.

Further, the cap 2 is provided with a cylindrical long aperture 11 in which the pivot housing 3, 3' is fixedly fitted when the halves are put together.

In FIG. 3, the cap 2 is not a bisected but an integral one and it is shown split in order to illustrate the construction of the inner cylindrical long aperture. Designated at 41, 41' is a rotor bearing member adapted to be fitted over a bearing hemispherical body formed on the lower portion of the pivot housing 3, 3'.

The rotor bearing member 41, 41', like said pivot housing, is of the split type which is characteristic of the present invention, designed to be strongly united by a washer 40 for jointing the leg portion of the split bearing member 41, 41' and by a rotor housing 42 adapted to integrally embrace the rotor bearing member 41, 41', thereby constituting a vertical suspension device according to the present invention.

In the embodiment of the invention, the rotor bearing member 41, 41' is functionally the most important part. That is, besides the bearing function of self-centerably and rotatably suspending the lower assembly, the front end of the leg is provided with a clutch functional portion which performs its own peculiar action and the upper disc surface is opposed to the lower end surface of the pivot housing projecting at the center inner portion of the top cap, with a particular clearance therebetween, so that in bobbin hanger operation, it performs also the functions of a stop and a shock absorber or damper. Further, the central position of a filter F of dust-proof construction to be later described is held by the circular edge of the tray-shaped circular plate which also helps the filter F to provide a sufficient dust-proof effect.

Further, the rotor housing 42 for integrally embracing the rotor bearing member 41, 41' to suspend the lower assembly from the pivot P serves the following important role. Thus, it unites the split rotor bering member 41, 41' in such a manner as to embrace the latter with pivot 1 inserted in the inner recess; after the washer 40 is tightly fitted over the leg from the front end thereof to unitarily constrain the same, this unitary assembly is completely received in the cylinder of the rotor housing 42 in a tightly fitted condition to serve as a core to tighten the upper portion of the rotor housing 42, thus providing a strong unitary lower structure.

The second feature of the present invention is the provision of a dust-proof structure for prevention of entry of fly and dust into the rotary bearing structure in an arrangement wherein the upper and lower assemblies in the vertical suspension device according to the present invention are joined together in a self-centering universal joint fashion.

Figure 1:
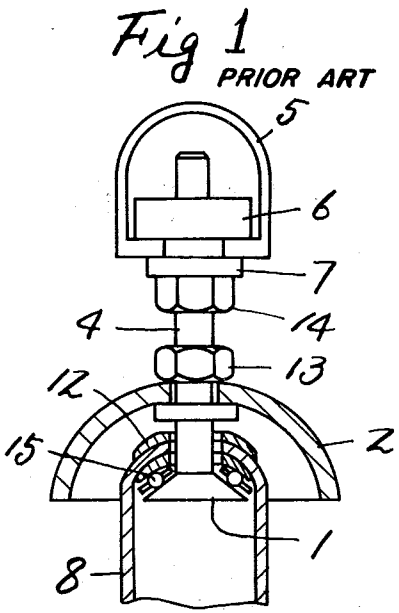
Fig 1 PRIOR ART
FIG. 1 shows a bobbin hanger upper assembly according to the prior art.

In spinning mills, measures against fly and dust are unavoidable important problems. It has been ascertained from of old that most of the causes of troubles to the gearing in the upper structure of the conventional bobbin hanger as shown in FIG. 1 are attributable to entry of fly in addition to rusting and dewing phenomena due to variations in temperature and humidity. As a conclusion drawn from the long-established actual results it has been considered that there is no other measure for protection against dust and fly then resorting to absolute sealing. As a bobbin hanger construction, however, in order to suspend the upper and lower assemblies in a self-centering rotatable manner, it is impossible to employ such absolute sealing system.

Although the conventional bobbin hanger has a kind of measure for protection against fly incorporated therein as shown in FIG. 1, the actual results have proved that it can hardly perform its role. That is, in terms of convection, head conduction and temperature and humidity, the measure for protection against dust and fly leaves the parts almost exposed, and the measure for protection of the rotary bearing against dust using a cover 12 to reduce the clearance as seen in FIG. 1 often produces adverse effects with respect to entry of fly.

Moreover, a bobbin hanger of the FIG. 1 construction having a lower actuating device of the piston type inside the rotor 8 entails more difficult problems connected with protection against fly.

As a measure for protection against fly in the present invention, first, fly and dust are conveyed by air currents. That is, the main bearing portion is isolated from ambient air and air current region in the hanger upper structure as much as design permits.

Secondly, the principle is to isolate the boundary clearance between the fixed parts and the slowly rotating parts from the outer atmosphere by a stationary air curtain layer enclosed in said clearance. As contrasted with this protection against entry of fly according to the second principle, the forcible elimination of such clearance would produce adverse effects on the protection of the rotating parts against entry of fly, as described above.

In the present invention, it has been found that the technique of combining wide, narrow and bent portions to connect the clearances successively effectively in series is more effective for protection against fly floating in the air.

Thus, the preventive system according to the present invention combines the above described two principles in a rational manner. As shown in FIG. 2, ambient air goes in and out of the space *f* as indicated by arrows as the rotor bearing member moves up and down as a result of the suspension action of the rotor bearing member.

Therefore, as shown in FIG. 2, the pivot 1 is installed in a sealed chamber isolated from the moving parts and communication with ambient air is through spaces *a, b, c, d* and *e.* The inlet *a* contacts ambient air over a relatively small area and the distance to the pivot is relatively long. Moreover, no current is produced in the wide, narrow and bent portions and there is formed a labyrinth effective to block the entry of fly.

Although some amount of alternating air current will be produced by the action of the rotor bearing member, owing to the very slow speed of the rotor bearing member and the reservoir effect of the intermediate wide space *c,* only a faint alternating current is produced in the inlet *a.* Long-term tests in spinning mills have proved that such various measures against entry of fly are effective particularly with respect to fine dust. However, it is necessary to exercise caution against the fly in a spinning mill tending to enter any clearance particulary defined between rotating parts as in an arrangement of bobbin hangers and in an area where there are various air currents including turbulent flow. There have been few cases where measures against fly under such unfavorable conditions are successful. Particularly where the fibers in the fly are long, the situation is aggravated. In the case of a bobbin hanger, if one end of a good fiber touches the bearing for one causes or another, it is instantly caught in the bearing. Fly tests on bobbin hangers have proved that even the above described means is still insufficient to avoid accidental occurrence of this phenomenon.

In view of the above, the present invention has completed a dust-proof device having a unique effect combined with the results of the later researches.

The principle is shown in FIG. 4, wherein the top cap inner aperture circular outer wall periphery 52 occupying a suitable outer peripheral length erected in a fixed condition inside a dust-proof chamber formed inside said top cap, and the rotary disc surface construction of a top clutch 55 forming the upper horizontal surface of the rotor R are utilized and a dust-proof float F (hereinafter referred to as filter) forming a conical partition wall is loosely fitted. This is a method in which the entry of long fibers having the danger of twining around the pivot P is blocked by this partition wall.

Generally, relatively long fibers in the fly floating on a rotating part has the characteristic of readily twining around a thin core. Therefore, they have a tendency to twine around a core of small diameter, such as the pivot P, extremely readily. In this case, if the circumference is longer than the staple length, twining, generally, will not take place. With this characteristic of fly taken into account, if all the circumferences of the related parts constituting a seal structure are suitably dimensioned, it is possible to form a sure seal structure against fly.

The construction of a suspension device according to the present invention is given an arrangement most suitable for application of this seal system, and it is characterized in that the related conditions are all met. Therefore, in an arrangement of the two combined, it is possible to provide an almost perfect dust-proof seal.

It is theoretically and experimentally proved that the dust-proof seal of the present invention will develop a superior sealing effect with respect not only to the usual short fiber fly as well as dust but also to a fly containing long fibers.

Moreover, this dust-proof seal is characterized in that it has almost no influence on the rotation resistance torque of a rotating part R, which is considered to be important. Thus, as a result of the fact that a superior seal construction for the bearings of bobbin hangers, the provision of which has been a long pending problem, has been accomplished, there is provided an arrangement which assures the performance and durability of a bobbin hanger for a prolonged period of time, resulting in remarkably improving its reliability and achieving a maintenance-free condition.

Features of the present invention will now be described with reference to embodiments thereof.

First of all, it is characterized in that the configurational design of the various elements constituting the internal space construction of the top cap C which is the main part of the suspension device is provided with precalculated conditions most effective for the dust-proof seal. A clearance 53 adjacent the lower edge of the cap which is the only path allowing the passage of fly has a specially selected sectional shape for prevention of entry of long fibers. At an important position in this space construction having the following combination of conditions, a conical filter F is installed as shown in such a manner as to isolate a reception chamber M for the pivot P from ambient air. That is, the upper portion of the conical filter F is located adjacent the upper corner in such a manner as to be positioned close to the internal cylindrical outer periphery 52 of the fixed upper assembly while the bottom edge of the conical filter F is closely contacted with the upper horizontal surface of the rotor R, so that the filter is positioned in an almost playing condition near the corner defined by a circular ring-like lateral wall erected around the circumference of said horizontal surface carrying the total weight of the filter F.

As a result, during the rotation of the rotor R, the filter F follows the movement of the rotor R while being restricted by the inner surface of the circular ring-like edge and continues rotating along with the rotor R while maintaining the central position which the filter F should assume. The well-prepared environmental conditions described above all act favorably, and even if an obstacle to rotation should be caused by fly taking various attitudes, the filter F itself skillfully and rationally adapts itself to this situation so as to retain the conditions for stability without interfering with the rotation of the rotor R.

The filter F is further characterized in that its blocking surface is always located at the greatest possible distance from the main position where there is the danger of causing twining around the pivot P and that the outer diameters of the upper and lower end surfaces of the filter and associated parts are such that their circumferences are above the limit (experimentally, 38 mm) where twining of fibers does not take place.

In this embodiment, the circumference of the surface 52 to which the upper edge of the filter F is disposed close is a little over 40 mm and the circumference of the lower edge thereof amounts to 75 mm.

Tests have proved that this fact, combined with the proper clearance between the upper assembly and the lower assembly forming the rotary part, makes it possible to form a fly- and dust-proof seal construction which is satisfactory for use in connection with the processing of long fibers such as synthetic fibers and wool as well as cotton.

Figure 4A:
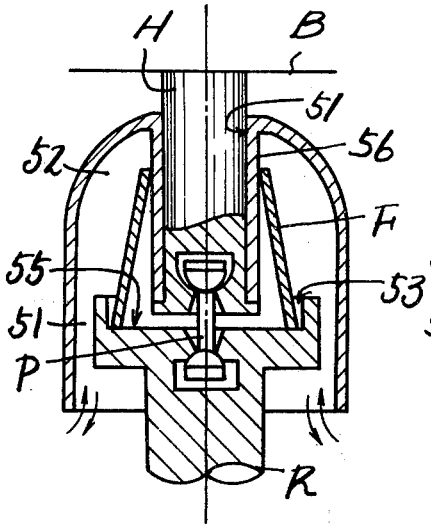
FIGS. 4A–4D are partial views of various dust-proof devices according to the present invention.
Figure 4B:
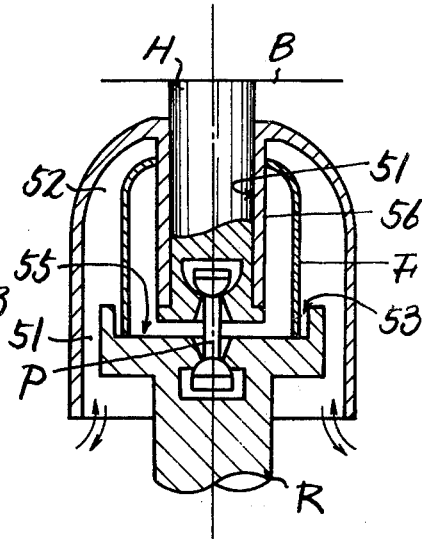
Figure 4C:
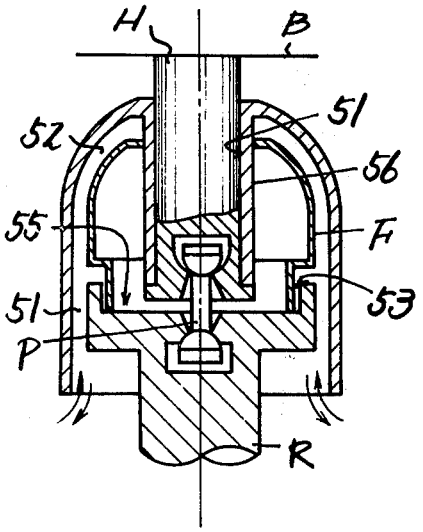

The shape of the filter F, when considered from the purport and principles described above, is not restricted to simple conical shapes shown in FIGS. 4A, B, C and D and many other shapes can be found, each developing its own characteristics.

Figure 4D:
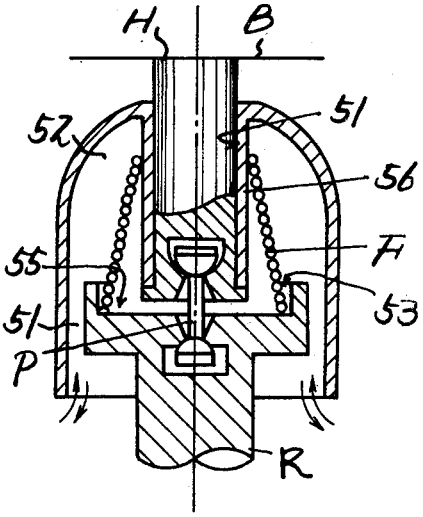
Figure 5:
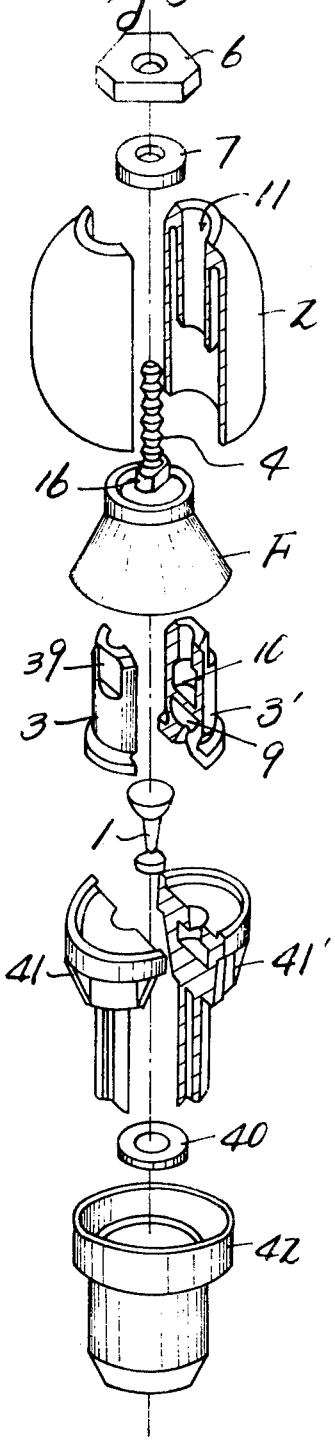
FIG. 5 is an exploded view of the upper assembly of the present invention.
Figure 6:
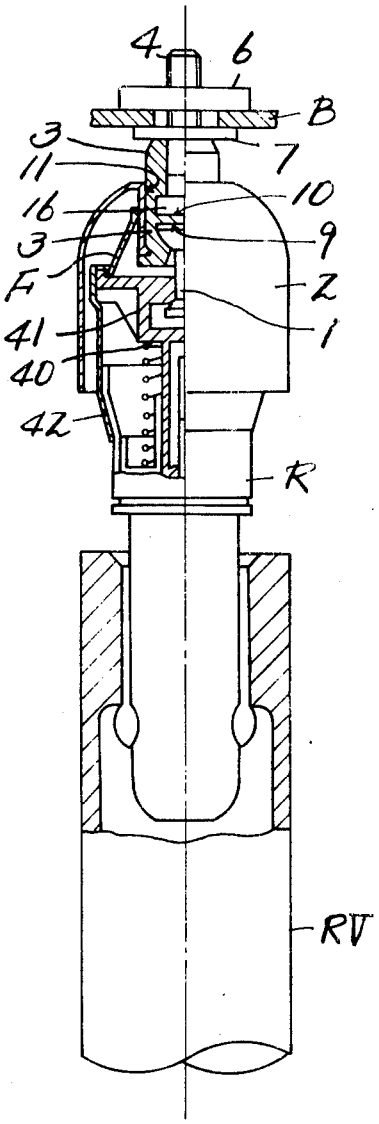
FIG. 6 is a sectional view of a typical vertical suspension device for bobbins, shown in its entirety, according to the present invention.

Further, various methods of production may also be contemplated. Metal plate shaping, molding and coiling are good examples thereof. Particularly, when a coiled filter shown in FIG. 4D is put into practical use, it has been proved that such filter has a decidedly superior effect as compared with flat simple cylindrical or conical forms made of metal plate or plastics. The effect factor which accounts for this reason is that the surface area which blocks fly can be several times larger than a flat type and that the surface unevenness facilitates the adhesion of fly to the surface in such a manner that the adhering fly collects as scattered over the entire surface of the filter. This phenomenon has the unique effect of gradually promoting the filter effect with the lapse of time. Particularly, it most effectively prevents long fibers from entering the filter. Further, the presence of some clearances is useful for arresting fly on the uneven surface. Therefore, there develops the action of further promoting the filter effect due to the deposition of fly concerning said coiled filter. That is, in the case where the filter surface is flat and has no clearance, no such effect is obtained and fly falls downward to form masses or slips in from below. If the coiled filter is conical, a superior effect can be expected. This effect can be explained by the fact that it is natural that spacing the rotor R as far as possible away from the pivot which is the object around which fly twines is effective for prevention of such twining. Another merit is that the inclined blocking surface has a stronger tendency than a vertical blocking surface to allow the layer of fly deposited thereon to become stabilized in that position. Further, if a fine wire is used to form a coil, it is possible to produce a filter which will flexibly accommodate itself to rotation. It is free to plan to produce filters which are best suited for individual fiber characteristics in accordance with the purport of the present invention. At any rate, the effective use of the present invention makes is possible to realize the desire for providing a seal construction which eliminates the trouble casued by twining of fly which has heretofore been considered unavoidable.

Thus, there is no possibility of entry of fly and dust.

The third feature of the present invention is that the outer side of the cap 2 depends downwardly over a long distance with the inner peripheral surface of its lower edge opposed to and disposed adjacent the outer periphery of the lower portion of the rotor housing 42 with a predetermined relatively narrow space therebetween, so that the swing motion of the rotor housing 42 constructed to swing with the pivot 2 as a double joint core is confined within the given limits naturally determined by the inner periphery of the lower edge of the cap.

Further, when the suspended body is swung by external forces, its amplitude is restricted and the initial attenuation is accelerated. This is useful for protecting the function of the important bearing and preventing aggravation in quality due to the swing of bobbins of roving and is an indispensable condition for retention of the bobbin hanger function.

The features of the present invention may be summarized as follows.

As the upper assembly of the vertical suspension device of the self-centering universal joint type:

a. In pursuit of rationality matching with the times, any loss in design is avoided to assure ruggedness, reliability, safety, convenience and neat appearance. The reliability of the function is very great, thus remakably improving yarn quality and operational stability.

b. The pivot housing and cap are moldings, and since the pivot housing is split, though complicated in design it is very easy to manufacture and assemble and the cost is low.

c. The parts are small in number and easy to manufacture with no waste of material. The molds are easy to design and produce with high precision.

d. The mounting and dismounting operation with respect to the hanger attaching body can be effected easily, quickly and securely without requiring a great amount of skill.

e. Standardization is simple and easy.

f. The self-centering universal joint type bearing pivot and the creel attachment bolt are isolated by the housing assembly in terms of operation, air convection and heat conduction. In the textile machine bobbin hanger bearing structure embodying the present invention, the protection of the bearing pivot is perfect and rational, assuring retention of the normal function with high reliability.

While there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. A bobbin hanger construction comprising bolt means for mounting at its upper end to a hanger attaching rail, bisected pivot housing means, cap means having an internal recess portion formed therein for receiving said pivot housing means thereinto, said bisected pivot housing means having an internal upper recess therein for receiving the bottom end of said bolt means thereinto, said pivot housing having an internal lower recess at its bottom end thereof, a bearing pivot element having its upper end thereof positioned within the internal lower recess of said pivot housing, a bisected rotary bearing member having an internal upper recess portion in the top portion thereof receiving the bottom end of said pivot element therein, the upper free end surface of said rotary bearing member having a top recess therein, said pivot housing means having a bearing hemisphere at its bottom end thereof positioned in the top recess of said rotary bearing member and a rotary housing member mounted on the body of said rotary bearing member in encircling relationship forming a vertical suspension element thereby for receiving a bobbin therein.

2. A bobbin hanger construction in accordance with claim 1, which further includes a closed chamber member isolated from the outside for receiving said bearing pivot element therein, said chamber member resulting in the path to ambient air being defined by a long clearance having a combination of wide, narrow and bent spaces.

3. A bobbin hanger construction in accordance with claim 1, wherein cap means form a space between said rotary bearing member and said pivot housing and dust-proof element means for blocking fly, dust and the like positioned in said space.

4. A bobbin hanger in accordance with claim 3, wherein said dust-proof element means constitutes a flat cylindrical body made of a material selected from the group consisting of metal plate and plastics.

5. A bobbin hander construction in accordance with claim 3, wherein said dust-proof element means is in the form of a coiled cylindrical body.

6. A bobbin hanger construction in accordance with claim 3, wherein said dust-proof element means is in the form of a frusto-conical body.

7. A bobbin hanger construction in accordance with claim 4, wherein the dust-proof element means is positioned on the top recess of said rotary bearing member, the upper portion of said dust-proof element means being loosely fitted over the wall of the recess portion of the cap means receiving the pivot housing means.

* * * * *